United States Patent [19]

Nagashima

[11] Patent Number: 4,457,346

[45] Date of Patent: Jul. 3, 1984

[54] WEFT INSERTING NOZZLE OF AN AIR-JET TYPE WEAVING LOOM

[75] Inventor: Mamoru Nagashima, Nagoya, Japan

[73] Assignee: Nissan Motor Co., Ltd., Yokohama, Japan

[21] Appl. No.: 390,551

[22] Filed: Jun. 21, 1982

[30] Foreign Application Priority Data

Jul. 2, 1981 [JP] Japan ..... 56-102252

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 2,028,387 2/1980 Manders ..... 139/435

*Primary Examiner*—Henry Jaudon

*Attorney, Agent, or Firm*—Thompson, Birch, Gauthier & Samuels

[57] ABSTRACT

An outer body has an axially extending through hole with a frusto-conical section thereof. An inner body is coaxially disposed in the outer body hole. The inner body has a frusto-conical end portion which is spacedly received in and spaced from the frusto-conical hole section of the outer body to define therebetween a frusto-conical space which acts as an air jet opening. The inner body has therein an axially extending through hole. A weft guiding body having therein an axially extending through hole for receiving therein a weft yarn is coaxially disposed in the inner body hole. The weft guiding body has an extension which projects from the apex of the frusto-conical end portion of the inner body and terminates at a position between the apex and the exit of outer body hole. The inner body is axially movable relative to the outer body, and the weft guiding body is axially movable relative to the inner body.

9 Claims, 3 Drawing Figures

WEFT INSERTING NOZZLE OF AN AIR-JET TYPE WEAVING LOOM

BACKGROUND OF THE INVENTION

The present invention relates in general to a weft picking device of an air-jet type weaving loom in which a weft yarn is blown into the warp shed by means of air jet action, and more particularly, to an improvement in a weft inserting nozzle of the weft picking device.

SUMMARY OF THE INVENTION

It is an object of the present invention to provide a weft inserting nozzle of an air-jet type weaving loom, which is applicable to various types of weft yarns simply by adjusting the parts mounted therein.

It is another object of the present invention to provide a weft inserting nozzle of an air-jet type weaving loom, which is constructed to facilitate the adjustment of the parts mounted therein.

In accordance with the present invention, there is provided a weft inserting nozzle of an air-jet type weaving loom, which comprises an outer body having therein an axially extending through hole with a frusto-conical section thereof; an inner body coaxially disposed in the outer body hole and axially movable relative to the same, the inner body having at its one end a frusto-conical portion which is received in and spaced from the frusto-conical hole section of the outer body to define therebetween a frusto-conical space from which pressurized air is adapted to be ejected toward the exit of the outer body hole, the inner body having therein an axially extending through hole reaching the apex of the frusto-conical portion of the inner body; and a weft guiding body coaxially disposed in the inner body hole and axially movable relative to the same, the weft guiding body having an extension which projects from the apex of the frusto-conical portion of the inner body and terminates at a position between the apex of the inner body and the exit of the outer body hole, the weft guiding body having an axially extending through hole through which a weft yarn is adapted to pass.

BRIEF DESCRIPTION OF THE DRAWINGS

Other objects and advantages of the present invention will become clear from the following description when taken in conjunction with the accompanying drawings, in which.

DESCRIPTION OF THE PRIOR ART

Prior to describing the weft inserting nozzle of the present invention, a conventional nozzle will be described with reference to FIG. 1 in order to clarify the invention. The conventional nozzle shown and described is the one disclosed in Laid-open Japanese Utility Model Application Specification No. 53-27170.

Figure 1:
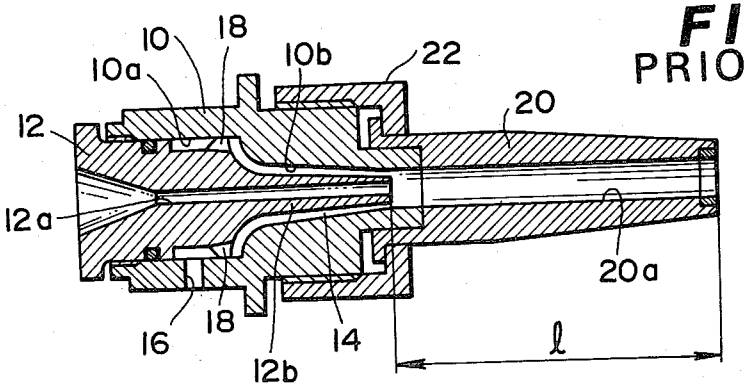
FIG. 1 PRIOR ART
FIG. 1 is a sectional view of a conventional weft inserting nozzle.

Referring to FIG. 1 of the accompanying drawings, there is shown a conventional weft inserting nozzle of an air-jet type weaving loom. The nozzle comprises generally an outer body 10 having therein an axially extending through hole which includes a right cylindrical section 10*a* and a frusto-conical section 10*b*. An inner body 12 is coaxially disposed in and is axially movable relative to the hole of the outer body 10. The inner body 12 has therein an axially extending through hole 12*a* through which a weft yarn (not shown) is adapted to pass. The inner body 12 has a frusto-conical portion 12*b* which is received in but is spaced from the frusto-conical section 10*b* of the outer body 10 to define therebetween a frusto-conical space 14. The space 14 is connected to an air inlet opening 16 formed in the outer body 10 into which pressurized air produced by a known compressor (not shown) is introduced to produce an air jet moving through the space 14. Designated by numeral 18 are air stabilizers mounted on the inner body 12 to stabilize the pressurized air flow directed toward the space 14. A tubular body 20 is connected to the outer body 10 by a coupler 22 in such a manner that an axially extending through hole 20*a* of the tubular body 20 is coaxial with the frusto-conical space 14.

However, the above-mentioned conventional nozzle has several drawbacks in controlling the weft traction force of jetted air with which a weft yarn is picked into the warp shed. As is known, for the purpose of achieving an assured picking, it is necessary to adjust the weft traction force in accordance with the property of the weft yarn used. In the conventional nozzle mentioned hereinabove, the adjustment of the weft traction force is made by axially moving the inner body 12 relative to the outer body 10 and/or exchanging the tubular body 20 with another one having a different longitudinal length. By moving the inner body 12, the sectional area of the frusto-conical space 14 is varied thereby changing the flow rate of pressurized air flowing therethrough. However, the axial movement of the inner body 12 induces inevitably a change in the effective length l of the tubular body 20, that is, the length between the apex of the frusto-conical portion 12*b* of the inner body 12 and the exit of the tubular body hole 20*a*. In other words, in the conventional nozzle, it is impossible to adjust the sectional area of the air-jet opening (or the space 14) without making a change of such distance l. This is quite inconvenient when requiring a precise controlling of the traction force.

In addition to the above, usually, the changing rate of the sectional area of the space 14 relative to the axial displacement of the inner body 12 is set relatively high in order that the adjustment of the sectional area does not cause a notable change of such distance l. However, this creates difficulties in adjusting the sectional area because even a slight axial movement of the inner body 12 causes a great change of the sectional area of the space 14.

Further, in the above-mentioned conventional nozzle, a number of tubular bodies 20 having different lengths are necessary in order to provide various degrees of traction forces. In addition, when the tubular body 20 is exchanged with another one having a different length, the distance between the exit end of the tubular body and a neighboring edge of the woven fabrics is inevitably changed. This is undesirable when considering that such distance should be made as small as possible for achieving better picking.

DESCRIPTION OF THE INVENTION

Therefore, a solution of the above-mentioned several drawbacks is an essential object of the present invention.

Figure 2:
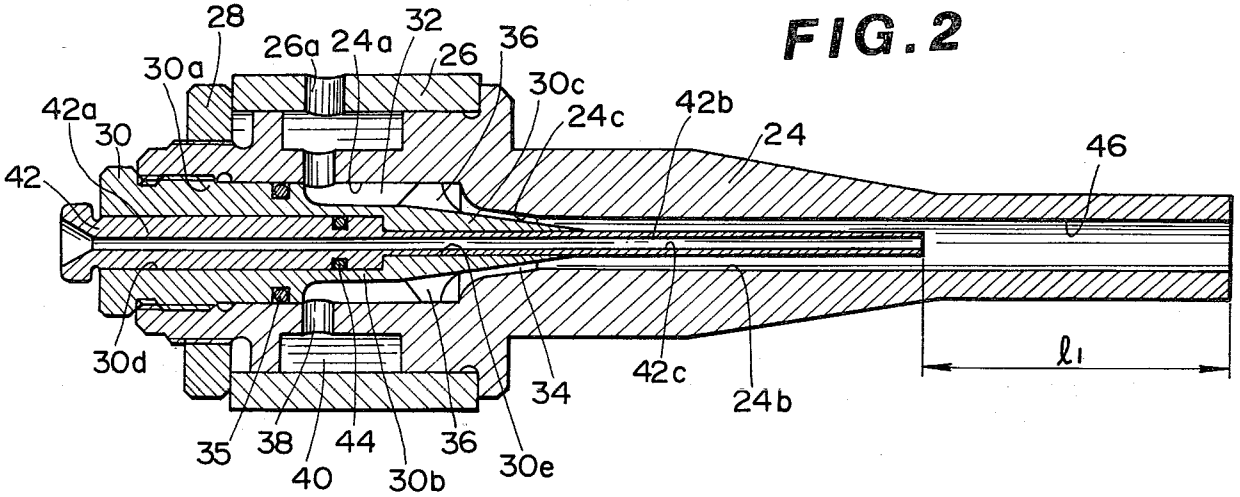
FIG. 2 is a sectional view of a weft inserting nozzle according to the present invention.
Figure 3:
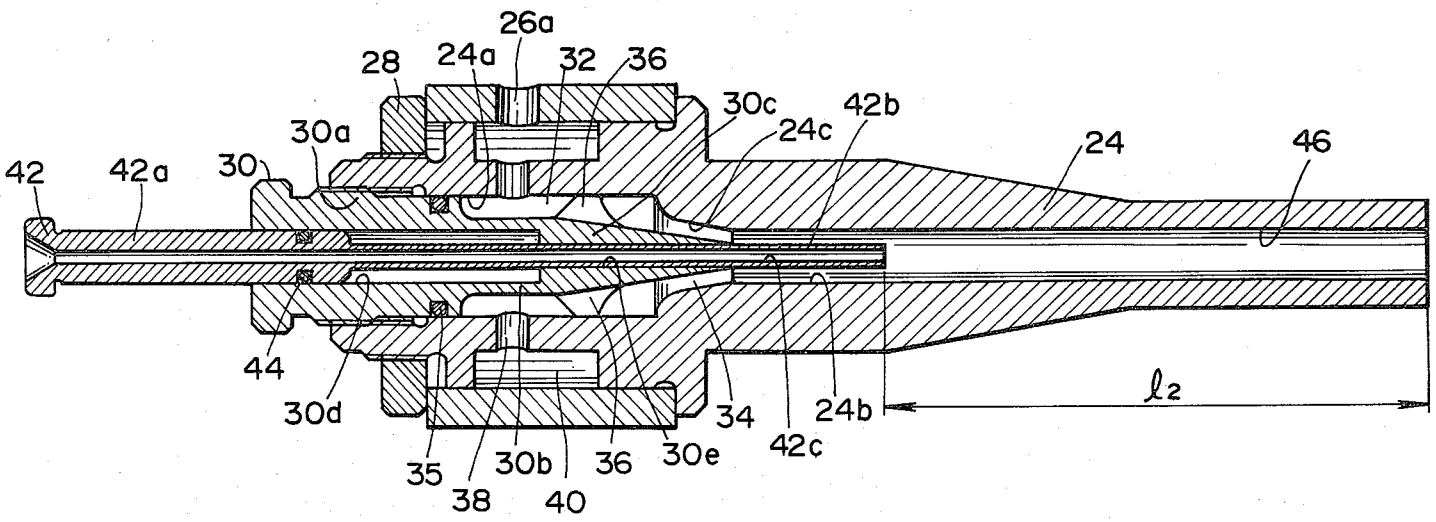
FIG. 3 is a sectional view of the nozzle shown in FIG. 2, but showing a different operating condition of the nozzle.

Referring to FIGS. 2 and 3, there is shown a weft inserting nozzle according to the present invention. The nozzle comprises an elongated cylindrical outer body 24 tightly held by a holder 26 which is secured to a frame of a weaving loom (not shown). A ring connector 28 is screwed on an end of the outer body 24 to assure a tight connection between the outer body 24 and the holder 26. The outer body 24 has an axially extending cylindrical through hole which includes a larger diameter section 24*a*, a smaller diameter section 24*b* and a frusto-conical intermediate section 24*c* which is interposed between the larger and smaller diameter sections 24*a* and 24*b*.

A cylindrical inner body 30 is coaxially disposed in the hole of the outer body 24, which inner body includes a larger diameter portion 30*a* screwed to the larger diameter hole section 24*a* of the outer body 24, a smaller diameter portion 30*b* received in but spaced from the remaining part of the section 24*a* of the outer body 24 to define therebetween a cylindrical space 32, and an elongated frusto-conical portion 30*c* which extends smoothly from the smaller diameter portion 30*b* toward the smaller diameter hole section 24*b* of the outer body 24 to define thereabout a frusto-conical space 34 (or air jet opening) merged with the cylindrical space 32. With the screwed connection between the inner and outer bodies 30 and 24, rotation of the inner body 30 about the axis thereof induces an axial displacement thereof relative to the outer body 24. An O-ring 35 is mounted about the larger diameter portion 30*a* of the inner body 30 to assure sealing between the slidably engaging surfaces of the bodies 30 and 24. Equally spaced-apart air stabilizers 36 are mounted on the root of the inner body frusto-conical portion 30*c*, as shown. The cylindrical space 32 and thus the frusto-conical space 34 are connected to an air inlet opening 26*a* formed in the holder 26, through radially extending holes 38 and an annular groove 40 which are defined by the outer body 24. Although not shown, the air inlet opening 26*a* is connected to a known compressor so that pressurized air is introduced into the frusto-conical space 34 (or air jet opening) to form an air jet moving toward the exit of the outer body smaller diameter hole section 24*b*. The inner body 30 has an axially extending through hole which includes a larger diameter section 30*d* and a smaller diameter section 30*e*.

A weft guiding cylindrical body 42 is coaxially disposed in the hole of the inner body 30 and is axially movable relative to the inner body 30. The body 42 includes a larger diameter portion 42*a* sealingly but slidably received in the larger diameter hole section 30*d* of the inner body 30, and a smaller diameter portion 42*b* which is partially received in the smaller diameter hole section 30*e* of the inner body 30. As shown in the drawings, the smaller diameter section 42*b* projects from the apex of the frusto-conical portion 30*c* of the inner body 30 and terminates at a position between the apex and the exit of the outer body smaller diameter hole section 24*b*. An O-ring 44 is mounted about the larger diameter portion 42*a* of the body 42 to assure sealing between the slidably engaging surfaces of the bodies 30 and 42. The weft guiding body 42 has therein an axially extending through hole 42*c* of a uniform cross section therethroughout through which a weft yarn (not shown) is adapted to pass. The entrance of the hole 42*c* is formed into a frusto-conical shape for achieving easy and reliable insertion of the weft yarn thereinto.

With this construction, there is provided a so-called weft guiding passage 46 which is defined between the exit of the hole 42*c* of the weft guiding body 42 and the exit of the smaller diameter hole section 24*b* of the outer body 24. The passage 46, that is, the zone defined by $l_1$ in FIG. 2 or $l_2$ in FIG. 3, constitutes the effective length of the smaller diameter section 24*b*, which corresponds to the effective length l of the tubular body 20 of the conventional nozzle of FIG. 1.

In operation, pressurized air is introduced into the nozzle and adjusted in flow rate mainly at the frusto-conical space 34 and ejected or jetted therefrom toward the weft guiding passage 46. With this air jet flow, the weft yarn in the weft guiding body 42 is drawn out downstream toward the exit of the outer body smaller diameter hole section 24*b*, that is, toward the shed of warp yarns.

When changing the flow rate of the pressurized air flow in the nozzle is required for adjusting the weft traction force, the inner body 30 is rotated about the axis thereof in a given direction to induce an axial displacement of the inner body 30 relative to the outer body 24. With this displacement, the positional relationship between the inner body frusto-conical portion 30*c* and the outer body frusto-conical hole section 24*c* changes thereby changing the sectional area of the frusto-conical space 34. Thus, the flow rate of the pressurized air flow is changed, thus changing the weft traction force. The axial displacement of the inner body 30 relative to the outer body 24 may be seen when comparing FIG. 2 and FIG. 3.

When changing the effective length of the weft guiding passage 46 is required, the weft guiding body 42 is drawn from or pushed into the hole of the inner body 30 to a certain extent. It is to be noted that the axial movement of the weft guiding body 42 is achieved independently without changing the sectional area of the frusto-conical space 34. The axial displacement of the weft guiding body 42 relative to the inner body 30 may be seen when comparing FIGS. 2 and 3.

As is understood from the above description, in the nozzle according to the present invention, the sectional area of the air jet space 34 and the effective length of the weft guiding passage 46 can be controlled or adjusted independently, unlike the case of the abovementioned conventional nozzle. Thus, in the invention, the precise adjustment of the weft traction force can be achieved readily with shorter adjusting time. Further, since consideration of any mutual dimensional relationship between the air jet space 34 and the weft guiding passage 46 is unnecessary unlike the conventional nozzle, the changing rate of the sectional area of the air jet space 34 relative to the axial displacement of the inner body 30 can be made small in the present invention. Thus, the adjusting of sectional area of the air jet space 34 can be made with accuracy.

In conclusion, in accordance with the present invention, various kinds of weft yarns can be accurately handled by a single nozzle by only adjusting few parts mounted therein.

What is claimed is:

1. A weft inserting nozzle of an air jet type weaving loom, comprising:

an outer body having therein an axially extending through hole with a frusto-conical section thereof;

an inner body coaxially disposed in the outer body hole and axially movable relative to the same, the inner body having at its one end a frusto-conical portion which is received in and spaced from the frusto-conical hole section of the outer body to define therebetween a frusto-conical space from which pressurized air is adapted to be ejected toward the exit of the outer body hole, the inner body having therein an axially extending through hole reaching the apex of the frusto-conical portion of the inner body; and a weft guiding body coaxially disposed in the inner body hole and axially movable relative to the same, the weft guiding body having an extension which projects from the apex of the frusto-conical portion of the inner body and terminates at a position between the apex of the inner body and the exit of the outer body hole, the weft guiding body having an axially extending through hole through which a weft yarn is adapted to pass.

2. A weft inserting nozzle as claimed in claim 1, in which the hole of said outer body comprises a larger diameter section and a smaller diameter section which are united through said frusto-conical section thereof.

3. A weft inserting nozzle as claimed in claim 2, in which said inner body comprises a larger diameter portion axially movably and sealingly engaged with the wall of the larger diameter hole section of said outer body, and a smaller diameter portion which is located between said larger diameter portion and said frusto-conical portion and is received in and spaced from the remaining of said larger diameter hole section of said outer body to define therebetween a cylindrical space which is merged with said frusto-conical space.

4. A weft inserting nozzle as claimed in claim 3, in which said larger diameter portion of said inner body is engaged with the wall of said larger diameter hole section of the outer body by means of a screw connection, so that rotation of said inner body about the axis thereof induces an axial movement of the inner body relative to said outer body.

5. A weft inserting nozzle as claimed in claim 4, in which said outer body is formed with mutually communicated openings which are connected to said cylindrical space.

6. A weft inserting nozzle as claimed in claim 5, in which said mutually communicated openings are radially arranged about the axis of said outer body.

7. A weft inserting nozzle as claimed in claim 6, in which a plurality of air stabilizers are mounted on the frusto-conical portion of said inner body to stabilize a flow of air passing therethrough.

8. A weft inserting nozzle as claimed in claim 3, in which said weft guiding body is sealingly engaged with the wall of the hole of said inner body.

9. A weft inserting nozzle as claimed in claim 8, in which the hole of said inner body comprises a larger diameter section and a smaller diameter section, and in which said weft guiding body comprises a larger diameter section sealingly engaged with the wall of the larger diameter hole section of said inner body and a smaller diameter portion partially received in the smaller diameter hole section of said inner body.

* * * * *